United States Patent [19]

Morrison et al.

[11] 4,027,425

[45] June 7, 1977

[54] SOUND ACTUATED FIGURE TOYS

[76] Inventors: Howard J. Morrison, 1250 Deer Park Lane, Deerfield, Ill. 60015; Albert G. Keller, 3820 W. 59th St., Chicago, Ill. 60629

[22] Filed: Aug. 13, 1975

[21] Appl. No.: 604,425

[52] U.S. Cl. ..... 46/264; 46/138

[51] Int. Cl.[2] ..... A63H 13/00

[58] Field of Search ..... 46/245, 232, 45, 118, 46/136, 138, 139, 264, 265, 267; 272/31 P

[56] References Cited

UNITED STATES PATENTS

| | | | |
|---|---|---|---|
| 1,170,427 | 2/1916 | D'Oench | 46/139 X |
| 1,726,283 | 8/1929 | Yates | 46/232 X |
| 2,184,675 | 12/1939 | Kehm | 46/138 X |
| 2,247,329 | 6/1941 | Deitz | 46/264 X |
| 2,254,091 | 8/1941 | Rossi | 46/245 X |
| 2,270,142 | 1/1942 | Robinson et al. | 46/264 X |
| 2,307,296 | 1/1943 | Peyton | 46/245 X |
| 2,660,829 | 12/1953 | Estes | 46/118 |

FOREIGN PATENTS OR APPLICATIONS

| | | | |
|---|---|---|---|
| 967,424 | 8/1964 | United Kingdom | 46/264 |

*Primary Examiner*—F. Barry Shay

*Attorney, Agent, or Firm*—Mason, Kolehmainen, Rathburn & Wyss

[57] ABSTRACT

An amusement device which includes a phonograph portion and a dancing band portion having a plurality of articulated figure toys in the form of band members movably mounted on a housing. A motor in the housing is controlled by electronic circuitry responsive to the rhythm or beat of the music from the phonograph portion. The motor moves the toy figures in unison with the beat of the music.

1 Claim, 7 Drawing Figures

SOUND ACTUATED FIGURE TOYS

SUMMARY OF THE INVENTION

This invention relates to an amusement device and particularly to an apparatus which includes a plurality of dancing articulated toy figures operatively responsive to electric signals.

The toy figures are in a shape resembling band members capable of movement simulating dancing activities. The dancing band members are supported on top of a housing by support arms, all being driven in unison by an electric motor which drives the support arms in a reciprocating mode. A control means operatively controls the electric motor in a manner responsive to an electrical signal which, in the embodiment herein, is provided by the output of a phonograph amplifier. More particularly, the control means is responsive to move the dancing band members in unison or response to the beat of the particular music being played by the phonograph.

DESCRIPTION OF THE PRFERRED EMBODIMENT

Figure 1:
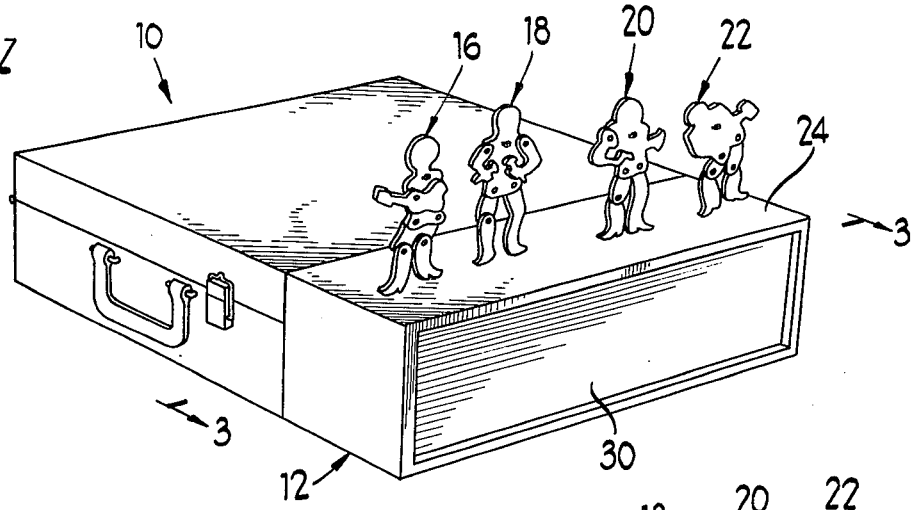
FIG. 1 is a perspective view of the apparatus of the present invention, with phonograph portion and band member portion assembled together.
Figure 2:
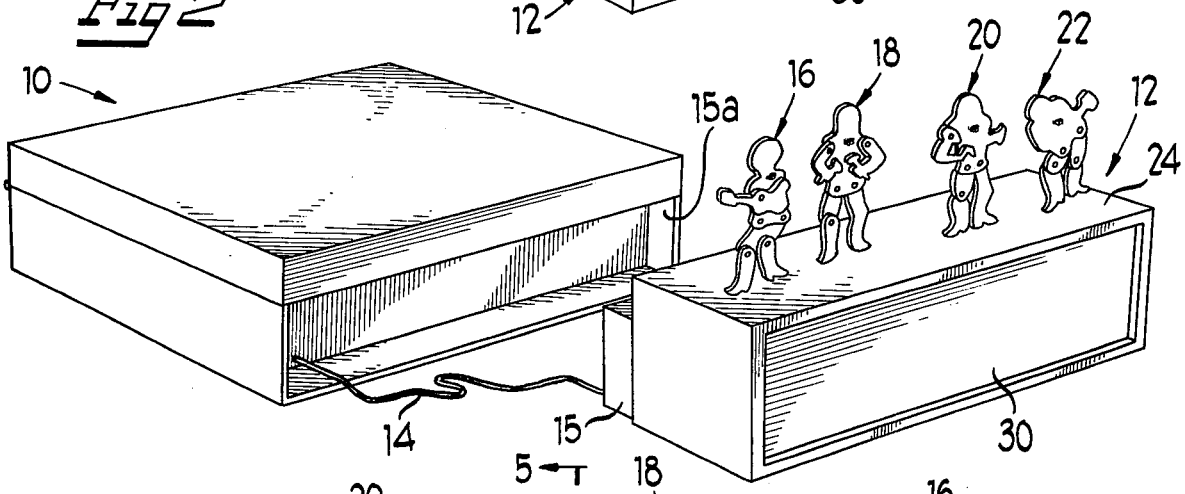
FIG. 2 is a perspective view similar to that of FIG. 1, showing the band member portion separated from the phonograph portion.

Referring to the drawings in greater detail and first to FIGS. 1 and 2, the device of the present invention includes a phonograph portion, generally designated 10, and a simulated dancing band mechanism, generally designated 12. The mechanism 12 is removably mounted to the phonograph portion 10 and is operatively connected thereto by a multiple wire electrical cable 14. As seen in FIG. 2, the dancing band mechanism 12 has a rectangular male portion 15 mountable within a complementary female portion or recess 15*a* in one side of the phonograph portion 10.

The dancing band mechanism 12 includes a plurality of articulated toy figure band members 16, 18, 20 and 22. Four band members are shown but more can be used. The band members 16, 18, 20 and 22 are supportably mounted above an enclosure 24 by means therein which vertically oscillates or jiggles the band members responsive to an electrical signal actuated motvie means, to be described hereinafter. The electrical signals are supplied by the phonograph 10 when a phonograph record is played thereby, but it is within the contemplation of the invention that other electrical sources may be used, such as music from a radio, television, tape recorder, or other source of audio or audio modulated electrical signals. The electrical signals and electrical power are transmitted between the phonograph portion 10 and the band portion 12 through the cable 14.

The band members are supported by a plurality of elongated vertical mounting arms 26, one for each band member. The mounting arms 26 are motivated in a vertical reciprocating manner in response to the electrical signals causing the band members to jiggle in a dancing manner.

Figure 3:
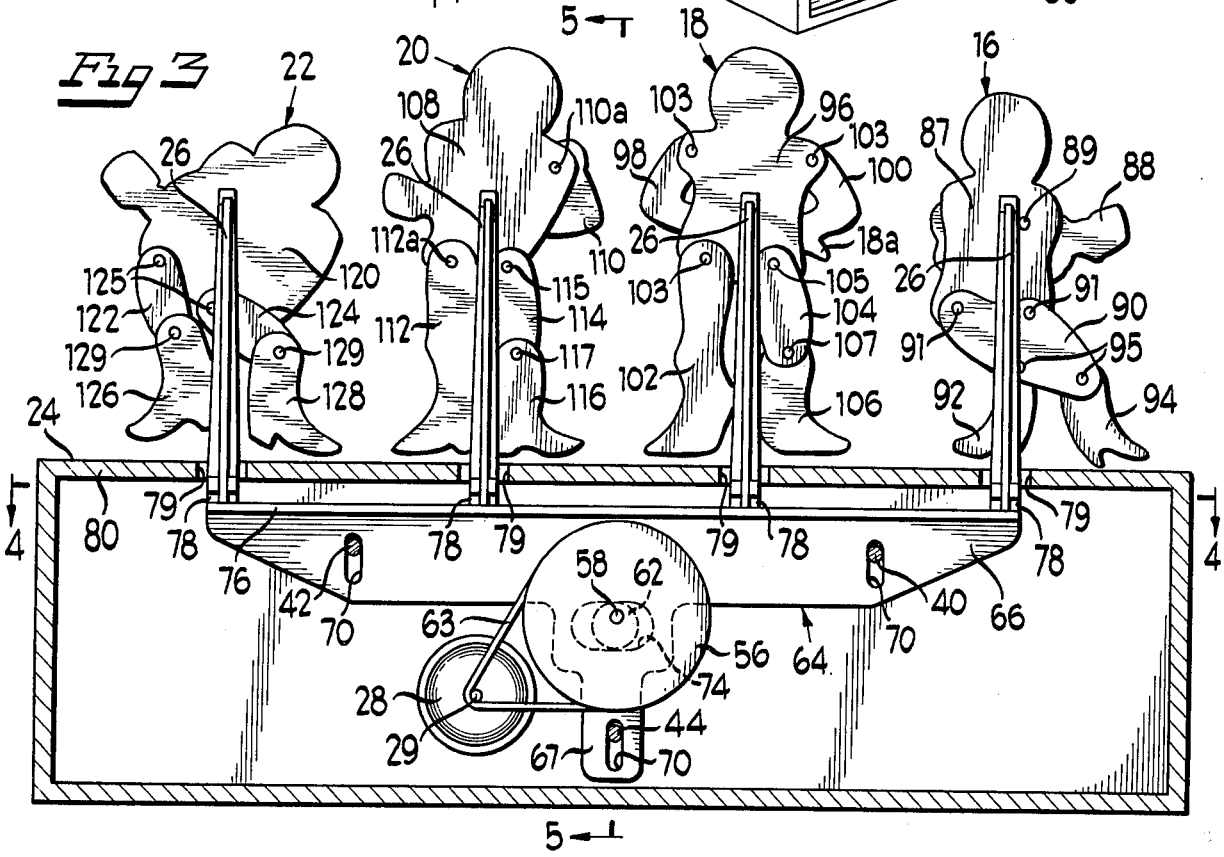
FIG. 3 is a vertical sectional view, on an enlarged scale, taken approximately along the line 3—3 of FIG. 1.
Figure 4:
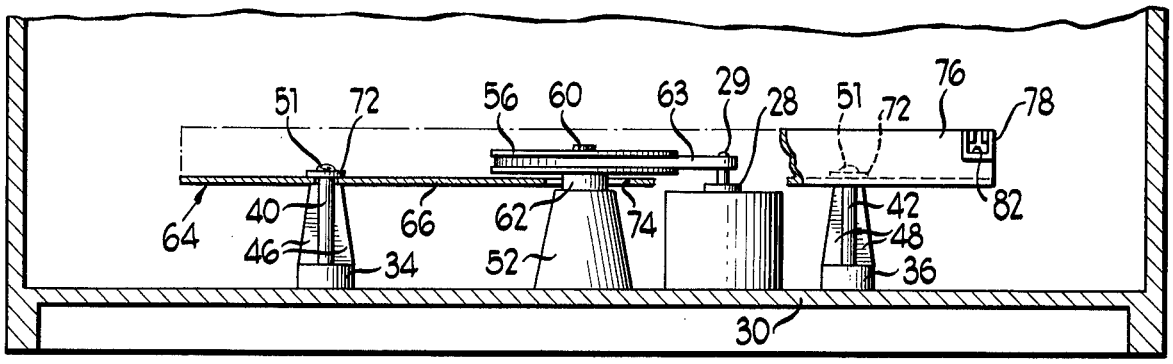
FIG. 4 is a fragmented horizontal sectional view taken approximately along the line 4—4 of FIG. 3.

More specifically, referring to FIGS. 3 and 4, a direct current motor 28, with a rotatable drive shaft 29, is mounted to a rear wall 30. Bosses 34, 36 and 38 extend horizontally inwardly from the rear wall 30. Horizontal guide arms 40, 42 and 44 extend inwardly from the bosses 34, 36 and 38, respectively. Tapered support flanges 46, 42 and 44, respectively, and terminate short of the inner ends of the guide arms. The guide arms 40, 42 and 44 are formed with small concentric holes in the ends thereof to accept a screw 51, or the like.

Figure 5:
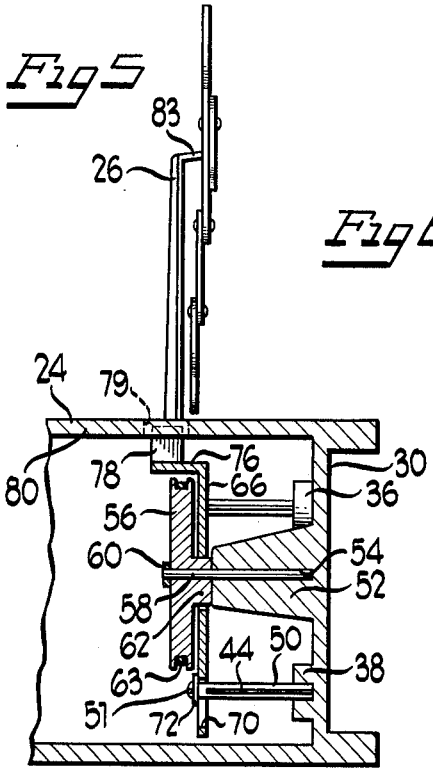
FIG. 5 is a fragmented vertical sectional view taken approximately along the line 5—5 of FIG. 3.

A circular tapered support boss 52 extends horizontally inward from the rear wall 30 and has a concentric axial circular hole 54 (FIG. 5) therein. A grooved pulley 56 is rotatably mounted on the boss 52 by a circular shaft 58 with a bearing shoulder 60 appended to its outer end. The shaft 58 passes freely through an appropriate concentric axial hole within the pulley 56 and is force fit into the hole 54. An eccentric cam 62 is formed on the inner face of the pulley 56 and bears against the boss 52. A belt 63 is wrapped about the motor shaft 29 and pulley 56, causing the pulley to rotate about the pin 58.

A drive plate, generally designated 64, for moving the FIGS. 16–22 includes a horizontal portion 66 (see FIG. 3) and a depending leg portion 67. The guide arms 40, 42 and 44 pass through vertically oriented elongated slotted holes 70 within the horizontal portion 66 of plate 64. The heads of the screw 51 retain the plate 64 between washers 72 and the ends of the flanges 46, 48 and 50, with the screws 51 bottomed out against the guide arms 40–44 and do not interfere with vertical movement of the plate 64. The guide arms 40, 42 and 44 provide vertical guidance for vertical movement of the plate 64.

The eccentric pulley cam 62 extends through a horizontally oriented elongated aperture 74 within the leg 67 of the plate 64 for bearing against the upper and lower edges thereof. Rotary motion of the eccentric cam 62 within the aperture 74 provides a drive for the plate 64 to reciprocally move the plat in a vertical plane guided by the guide arms 40, 42 and 44 extending through their respective appropriate vertically elongated slotted holes 70.

Figure 6:
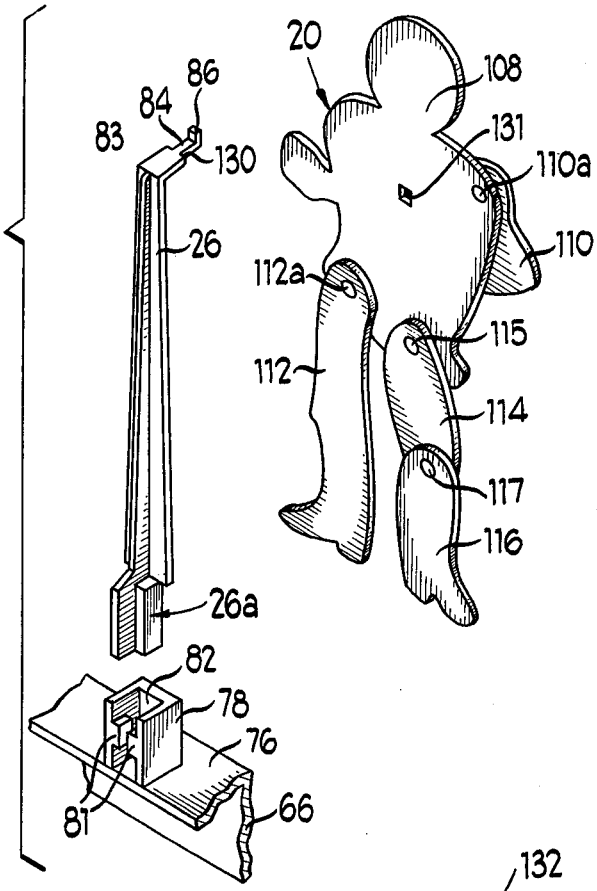
FIG. 6 is a fragmented exploded perspective view of a dancing figure and support arm therefore.

As shown in FIG. 6, a horizontal flange 76 is unitarily formed along the uppermost edge of the horizontal portion 66 of plate 64, at right angles thereto and extending inwardly therefrom. A plurality of tongue and groove mounts 78, one for each dancing band member, protrudes upwardly from the flange 76 beneath holes 79 in an upper housing wall 80 (FIG. 3). Each mount 78 is a generally U-shaped form with two generally rectangular protrusions 81 (FIG. 6) extending inwardly towards each other from opposite walls of the U to form a vertically oriented T-shaped groove 82. Each mount 78 supports and reciprocally drives one of the mounting arms 26 with its respective band member attached thereto.

Each elongated mounting arm 26 terminates at its lower end in a T-shaped portion 26*a* complementarily shaped to fit within the T-shaped slots 82 of the mounts 78. The upper end of each arm 26 has a right angled tab 83 extending horizontally rearwardly when the arm 26 is disposed within one of the mounts 78, narrowing into a tab 84 and an upwardly extending hook 86.

Referring to FIGS. 3 and 6, the dancing FIGS. 16–22 in the preferred embodiment are four in number representing singers, guitar players, or the like, of a music group. The dancing FIG. 16 has a body member 87, a guitar resembling member 88 pivotally attached thereto at 89, and a hip member 90 pivotally attached thereto at 91. Lower leg members 92 and 94 are pivotally attached to the hip member 90, at 95.

The dancing FIG. 18 has a body member 96 with two arm members 98 and 100 and a unitary leg 102, each pivotally attached to the body members at 103. A second leg has an upper portion 104 which is pivotally attached to the body 96 at 105 and a lower portion 106 pivotally attached to the upper portion at 107. The FIG. 18 has simulated maracas 18*a* at the ends of the arms 98 and 100.

The dancing FIG. 20 has a body portion 108 with an arm member 110 and a leg member 112 pivotally attached thereto, at 110*a* and 112*a*, respectively. A second leg 114 has an upper portion pivotally attached to the body portion 108, at 115 and has a lower leg portion 116 pivotally attached to the upper leg portion 114, at 117. The band member 22 has a body portion 120 and legs with upper portions 122 and 124 each pivotally attached to the body portion 120, at 125, and lower leg portions 126 and 128 pivotally attached to the upper leg portions at 129.

Referring to FIG. 6, the tab 83 abruptly narrows forming the tab 84 and a shoulder 130. The articulated figure toy, generally designated 20, has a rectangular aperture 131 approximately centrally located within the body porton 108 of sufficient size to permit the entry therethrough of the hook 86 and the tab 84 for abutment against the shoulder 130. In a similar manner, the body portions 87, 96 and 120 of the other articulated figure toys or dancing members have a similar aperture 131 and are similarly supported by their respective support arms 26.

As the motor shaft 29 rotates, thereby imparting a rotary motion to the pulley 56, the eccentric shoulder 62 alternately abuts the upper and lower edges of aperture 74, thereby vertically oscillating plate 64 along with the arms 26 which support the band members. The plate 64 is guided by arms 40, 42 and 44. The band members are caused to articulate about their respective pivot points.

Figure 7:
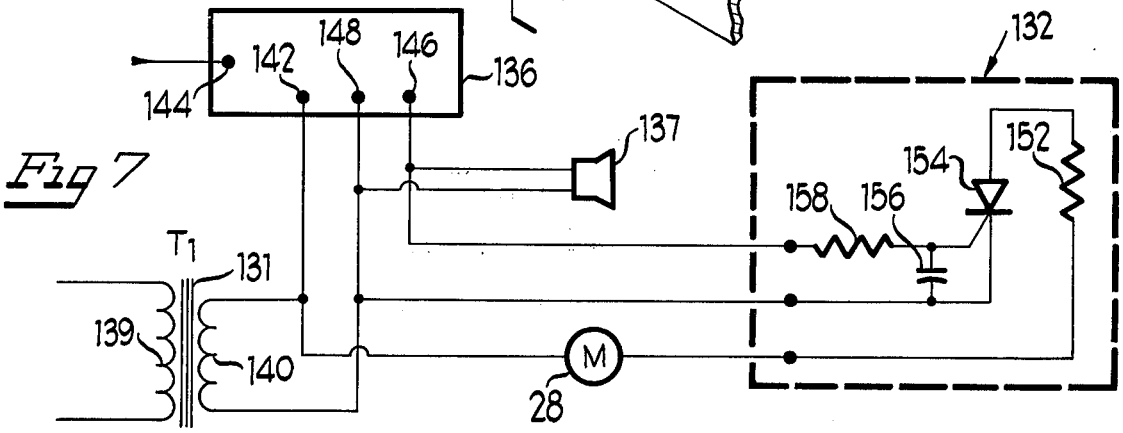
FIG. 7 is a schematic view of the electrical wiring for the apparatus of the present invention.

Referring to FIG. 7, the drive motor 28 is a direct current motor with an electrical rating sufficient to provide enough torque to drive the mechanism. The motor 28 is powered by a transformer 131, through wire 14 (FIG. 2) and is controlled by frequency responsive circuitry, generally designated 132. The phonograph 10 is used as an electrical signal source for the control circuitry and has a solid state amplifier 136 and a speaker 137. The phonograph is conventional having a rotating turntable (not shown), with a tone arm housing a transducer, and a stylus for sensing the information in the grooves of a phonograph record. The transducer or cartridge output then is amplified and modified, in this case by the amplifier 136, and in turn drives a sound transducer in the form of the speaker 137. The control circuitry 132 senses this amplified and processed information signal to control the motor in conjunction therewith. The control circuitry can be disposed either in the enclosure 24 or the pohonograph portion 10.

The transformer 131 supplies the power to the amplifier 136, the control circuitry 132 and the motor 28.

A primary winding 139 of the transformer 131 is connected to a main power to supply electrical power for both the motor and the transformer functions. A secondary winding 140 supplies a step-down AC voltage for the phonograph amplifier 136 and the motor 28. The amplifier 136 has an AC power supply input terminal 142, an information or signal input terminal 144 connected to the phonograph cartride, a speaker output terminal 146, and a common or ground terminal 148. The speaker 137 is connected between the speaker output terminal 146 and the ground terminal 148 to provide audible sound. The secondary winding 140 is connected to the amplifier terminals 142 and 148.

One terminal of the motor 28 is connected to the secondary winding 140 at the terminal 142. The other terminal of the motor 28 returns to ground by way of the control circuitry 132. More specifically, a resistor 152 is connected to the other terminal of motor 28. A controlled rectifier 154 is provided, the anode of which is connected to the other terminal of the resistor 152. The cathode of the controlled rectifier 154 is connected to ground and the other side of transformer winding 140 at the terminal 148. A capacitor 156 is connected between a gate terminal and the cathode terminal of the controlled rectifier 154 and a resistor 158 is connected between the gate terminal of the controlled rectifier 154 and the speaker output terminal 146.

The step-down AC voltage is applied to the motor 28 and the control circuitry 132 in series therewith. The controlled rectifier controllably switches the current to the motor in a uni-directional or rectifying manner. When the signal level at the speaker output terminal 146 is of sufficient amplitude, as with the "beat" of a particular piece of music, the positive excursions thereof are conducted to the gate electrode of the controlled rectifier 154 thereby turning the controlled rectifier on in a forward conduction mode and applying the secondary power supply voltage to the motor 28 causing the motor to rotate and drive the band members. When the signal level is not sufficient to cause the controlled rectifier 154 to conduct, the motor 28 receives no power. The resistor 158 and the shunting capacitor 156 form a low pass filter thereby limiting the response of the control circuitry to the beat of the music. The low pass filter negates the tendency of the control circuitry to be approximately continuously triggered which would have no relationship to the beat of the music. When the controlled rectifier 154 is triggered, a half wave rectified supply voltage is applied to the motor 28.

In one form of the invention, the resistor 158 has a value of 10K ohms and the capacitor has a value of 0.02 uf. The crossover frequency of this circuit is 800 Hz, however, a crossover frequency may be chosen above or below that value. The present embodiment, being a low voltage and low power control system, permits a higher value for the resistor 158 than may be normally used wih a controlled rectifier. In such a case, the value of capacitor 156 would change accordingly to maintain the same roll-off frequency. The resistor 152 serves as a current surge limiting resistor and has a value of 5 ohms with a 1 watt power rating.

It is within the contemplation of the invention that many equivalents are available as a substitute for the controlled rectifier, such as a triac, other gate controlled devices such as a SGS, or a transistor, the transistor permitting incremental control.

The foregoing detailed description has been given for clearness of understanding only and no unnecessary limitations should be understood therefrom as some modifications will be obvious to those skilled in the art.

We claim:

1. An amusement device, comprising:

a phonograph device including an amplifier;

a simulated dance band mechanism including a support structure mounted on said phonograph device and a plurality of articulated figure toys movably mounted on said support structure;

rotary drive means mounted in said support structure including cam means for moving said figure toys in a cyclic, generally vertical reciprocating manner relative to said support structure; and signal responsive control means connecting said drive means and said amplifier for energizing the drive means by a signal provided from the output of said amplifier and thereby moving said figure toys in response to a predetermined amplitude signal from said amplifier, said control means including a gated controlled rectifier in series with said drive means and a low pass filter connected between the amplifier and the gate of said controlled rectifier so that the drive means is energized by only low frequency signals at said predetermined amplitude.

* * * * *

UNITED STATES PATENT OFFICE
CERTIFICATE OF CORRECTION

Patent No. 4,027,425 Dated June 7, 1977

Inventor(s) Howard J. Morrison et al

It is certified that error appears in the above-identified patent and that said Letters Patent are hereby corrected as shown below:

Col. 2, line 15, after "46" delete "42 and 44" and insert --48 and 50, extend radially outward from the guide arms 40, 42 and 44,--; line 32, "FIGS." should be --figures--; line 48, "plat" should be --plate--.

Col. 3, line 5, "FIGS." should be --figures--; line 13, "FIG." should be --figure --; line 21, FIG. should be --figure --.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*